US005966146A

United States Patent [19]

Lee

[11] Patent Number: 5,966,146

[45] Date of Patent: Oct. 12, 1999

[54] SERVICE STATION HAVING A HEAD CAPPING DEVICE FOR ACCURATE SEALING OF PRINT HEADS

[75] Inventor: Yong-duk Lee, Gunpo, Rep. of Korea

[73] Assignee: SamSung Electronics Co., Ltd., Kyungki-do, Rep. of Korea

[21] Appl. No.: 08/885,998

[22] Filed: Jun. 30, 1997

[30] Foreign Application Priority Data

Jun. 30, 1996 [KR] Rep. of Korea ..... 96-19690

[51] Int. Cl.[6] ..... B41J 2/165

[52] U.S. Cl. ..... 347/33; 347/32

[58] Field of Search ..... 347/33, 30, 32, 347/29, 24

[56] References Cited

U.S. PATENT DOCUMENTS 4,506,277 3/1985 Terasawa .
4,825,231 4/1989 Nozaki .
5,103,244 4/1992 Gast et al. ..... 347/32
5,381,169 1/1995 Arai et al. .
5,440,331 8/1995 Grange ..... 347/32
5,563,637 10/1996 Francis et al. .
5,625,385 4/1997 Suzuki ..... 347/24

*Primary Examiner*—N. Le
*Assistant Examiner*—Thien Tran
*Attorney, Agent, or Firm*—Robert E. Bushnell, Esq.

[57] ABSTRACT

A printer head capping unit for improving the accuracy of capping with an ink cartridge having a guide groove and with a sled having a boss formed in an opposed shape. The head capping unit for an ink-jet printer having a wiper for wiping a surface having a nozzle hole of the printer head formed at the ink cartridge's lower part, a cap for sealing, a cap holder fixing the cap, a sled fixing the wiper and cap holder, and a main frame having the sled performing a sliding movement when a carriage having an ink cartridge reached a home position, comprises at the ink cartridge's lower part a guide groove being formed, and at the sled a boss being formed in a shape opposed to that of the guide groove so as to be closely inserted when the carriage reached the home position, thereby accurately sealing the nozzle surface of the printer head.

6 Claims, 4 Drawing Sheets

SERVICE STATION HAVING A HEAD CAPPING DEVICE FOR ACCURATE SEALING OF PRINT HEADS

CLAIM OF PRIORITY

This application makes reference to, incorporates the same herein, and claims all benefits accruing under 35 U.S.C. §119 from an application for HEAD CAPPING UNIT OF INK-JET PRINTER earlier filed in the Korean Industrial Property Office on Jun. 30, 1996 and there duly assigned Serial No. 19690/1996.

FIELD OF THE INVENTION

The present invention relates to a head capping unit of an ink-jet printer. More particularly, it relates to a head capping unit for accurately sealing a head portion when a carriage having finished a printing process reaches a home position, with a guide groove of an ink cartridge and a boss of a sled, especially considering the accuracy of capping.

DESCRIPTION OF THE RELATED ART

In an earlier ink-jet printer, sheets of paper sequentially fed from a paper feeding tray one by one are printed while each paper is passing through a printer head. The printer head having a plurality of nozzle holes is mounted at the lower part of an ink cartridge, and the ink cartridge is mounted on a carriage reciprocating from left to right by means of a shaft. Accordingly, when whole of the ink in the ink cartridge was consumed, the ink cartridge is easily demounted from the carriage for the possible exchange.

The carriage being connected with a timing belt is mounted to be reciprocated by means of a driving motor of a driving part, and a printing process is performed with ink being injected from the nozzle holes of the printer head of the cartridge. The printer head operating as described in the above is situated in a home position after finishing the printing process, and in the home position, a capping unit is normally mounted. An object of the capping unit is to prevent clogging by sealing the nozzle holes of the printer head.

U.S. Pat. No. 4,825,231 for a Cap Mechanism For Use With An Ink Jet Head to Nozaki and U.S. Pat. No. 4,506,277 for a Nozzle-Restoring Suction Device For Ink Jet Printer to Terasawa each disclose structures for capping and sealing the ink jet head when not in use. However, when the printer head reached the home position, there should be some extent of gap between the outer wall of the sled and the inner wall of the main frame so that the sled can be moved from the main frame. Accordingly, by the existence of the gap, when the printer head being mounted in the carriage reached the home position, the nozzle surface of the printer head is not accurately sealed. Due to this problem, deterioration of the accuracy of capping was caused. I have not seen the use of a groove in the print head and a correspondingly shaped boss on the sled to aid in the sealing of the print head when not in use.

SUMMARY OF THE INVENTION

The present invention was conceived to solve the earlier problems described in the above and an object of the present invention is to provide a printer head capping unit for improving the accuracy of capping with an ink cartridge having a guide groove and with a sled having a boss formed in a complementary shape.

To achieve such object, the present invention is characterized in that a head capping unit for an ink-jet printer having a wiper for wiping a surface having a nozzle hole of the printer head formed at the ink cartridge's lower part, a cap for sealing, a cap holder fixing the cap, a sled fixing the wiper and cap holder, and a main frame having the sled performing a sliding movement when a carriage having an ink cartridge reached a home position, comprises at the ink cartridge's lower part a guide groove being formed, and at the sled a boss being formed in a shape opposed to that of the guide groove so as to be closely inserted when the carriage reached the home position, thereby accurately sealing the nozzle surface of the printer head.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
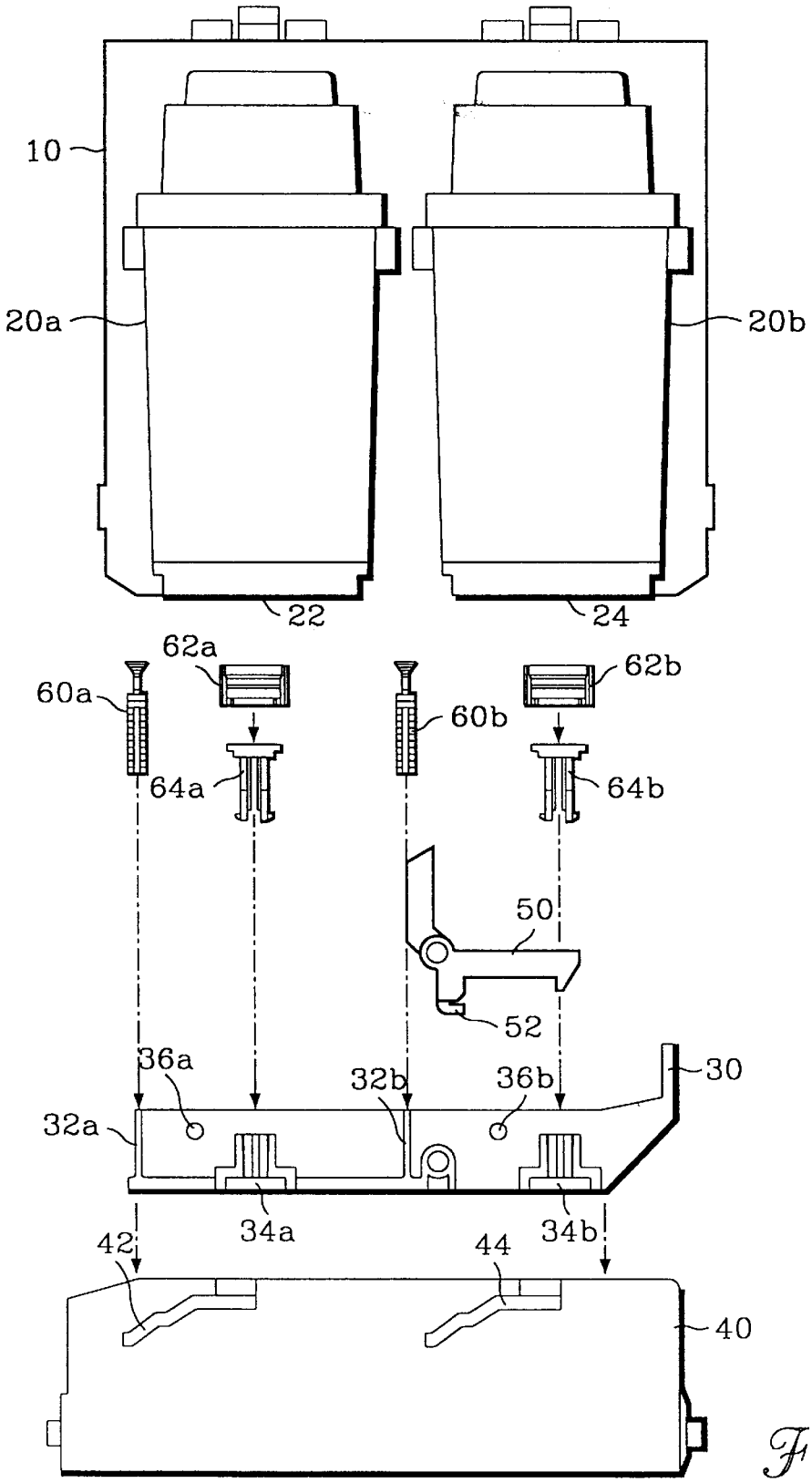
FIG. 1 is a side sectional view illustrating a head capping unit of an ink-jet printer in accordance with the conventional art.

Turning to FIG. 1, in an earlier capping unit for the ink-jet printer, wipers 60*a*, 60*b* having the material property of rubber are mounted to wipe off the nozzle holes of two printer heads 22, 24 moving toward the home position within a box-shaped main frame 40. Also, in such a case that the wiped heads 22, 24 pass through the wipers 60*a*, 60*b* and are situated on the home position, caps 62*a*, 62*b* made of rubber are mounted in a shape opposed to that of the heads 22, 24 so as to seal the nozzle holes of the printer heads 22, 24.

The one wiper 60*a* having a longish groove is fixed on a rib 32*a* of a sled 30, and another wiper 60*b* is fixed on a rib 32*b* of the sled 30. Thus, as the material property of the wipers 60*a*, 60*b* is rubber, some extent of elasticity is applied to when the head is passing through, but this enables the surface of the nozzle holes to get in contact with the upper surface of the wipers 60*a*, 60*b* to wipe ink by sliding on in a closely adhered state.

The caps 62*a*, 62*b* are fixedly inserted into cap holders 64*a*, 64*b*, and the cap holders 64*a*, 64*b* are fixed at the sled 30. The sled 30 has the ribs 32*a*, 32*b* for fixing the two wipers 60*a*, 60*b*, and fixing parts 34*a*, 34*b* are formed to fix the cap holders 64*a*, 64*b*.

On the most lateral surface of the sled 30 supporting shafts 36*a*, 36*b* is formed, and accordingly when the sled 30 of the main frame 40 is mounted, the supporting shafts 36*a*, 36*b* are inserted into sliding grooves 42, 44 formed on the lateral surface of the main frame thereby the sled 30 is moved in a horizontal or inclined direction along with the grooves 42, 44.

As a result, as the wipers 60*a*, 60*b* are mounted in the course of reaching the home position after ink cartridges 20*a*, 20*b* mounted on a carriage 10 reciprocating finishes the printing process, ink on the surface having the nozzle holes of the printer heads 22, 24 is wiped off by performing the sliding contact with the upper surface of the wipers 60*a*, 60*b*.

Subsequently, when the printer heads 22, 24 reach the home position completely, namely, when the sled 30 reaches the far right side of the sliding grooves 42, 44, the printer heads 22, 24 are sealed by the caps 62*a*, 62*b* to prevent the clogging of ink. In order to perform the printing process again, by means of the carriage 10 being conveyed, the sled 30 is moved to the far left side of the sliding grooves 42, 44, as a tension coil spring is mounted in a lever wiper 50 having a projection 52.

Figure 2:
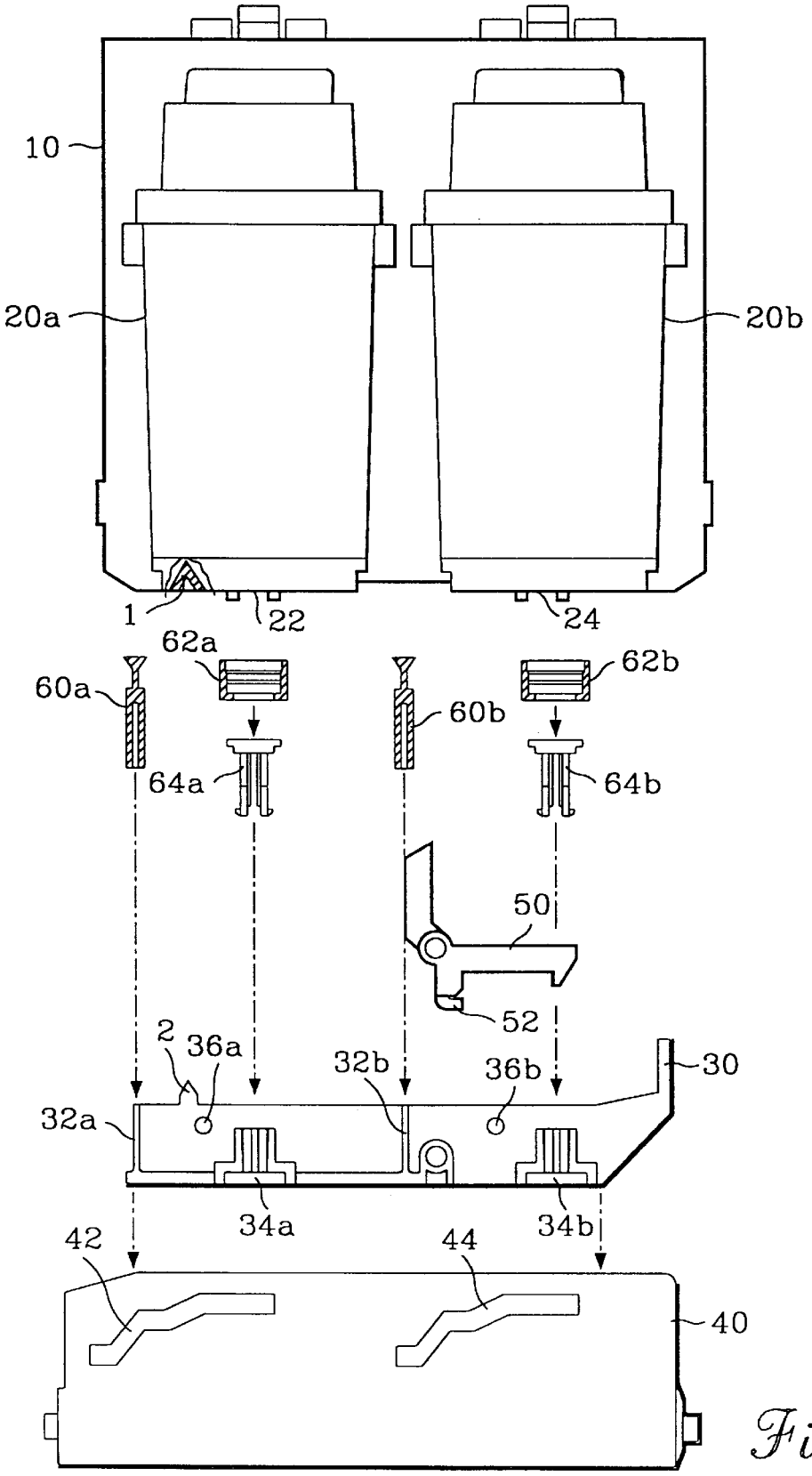
FIG. 2 is a side sectional view illustrating a head capping unit of an ink-jet printer in accordance with a desirable embodiment of the present invention.

Turning to FIG. 2, after the printing process has been performed on sheets of paper, the carriage 10 having ink cartridges 20*a*, 20*b* is conveyed toward a home position by a timing belt being driven by a driving motor. In a capping unit made up of wipers 60*a*, 60*b* for wiping a surface having nozzle holes of printer heads 22, 24 being mounted at the lower part of earlier ink cartridges 20*a*, 20*b*, caps 62*a*, 62*b* for sealing, cap holders 64*a*, 64*b* fixing the caps 62*a*, 62*b*, a sled 30 fixing the wipers 60*a*, 60*b* and the cap holders 64*a*, 64*b*, and a main frame 40 having the sled to perform a sliding movement, a guide groove 1 is formed at the lower surface of the ink cartridge 20*a* when the carriage 10 reaches the home position, so as to accurately seal the surfaces having nozzle holes of the printer heads 22, 24. Also, at the sled 30 a boss 2 is formed in a shape corresponding to that of the guide groove 1. The sled can be moved between a first position and a second position. The first position is the position the sled is in prior to any contact being made between the carriage and the sled gap. The second position is where the sled is positioned so that the boss is inserted into the guide groove of the carriage and the caps that are supported by the cap holders have covered the nozzles of the print heads.

Figure 3A:
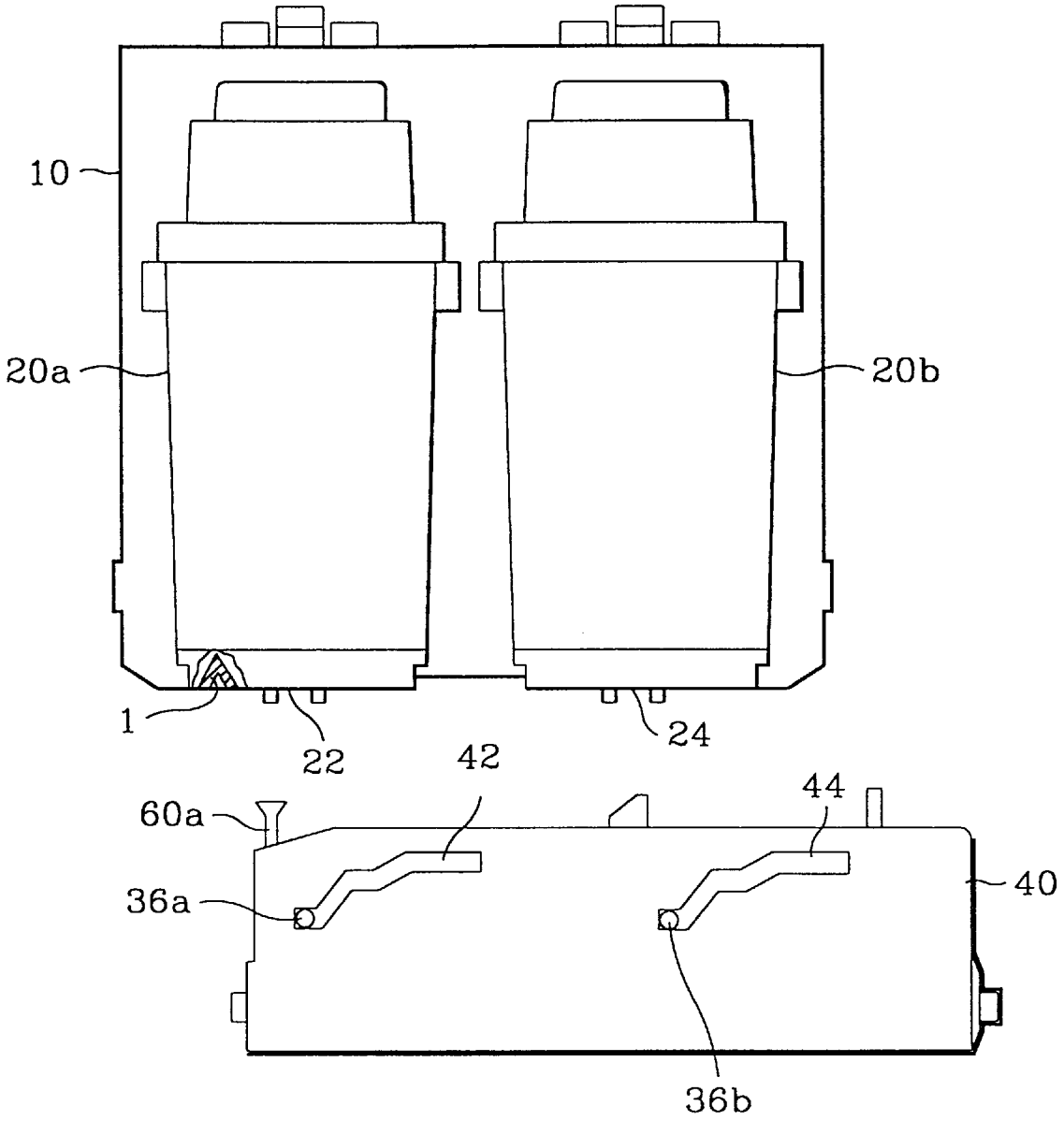
FIGS. 3A and 3B are side elevation views illustrating the operation of the head capping unit in accordance with one embodiment of the present invention.
Figure 3B:
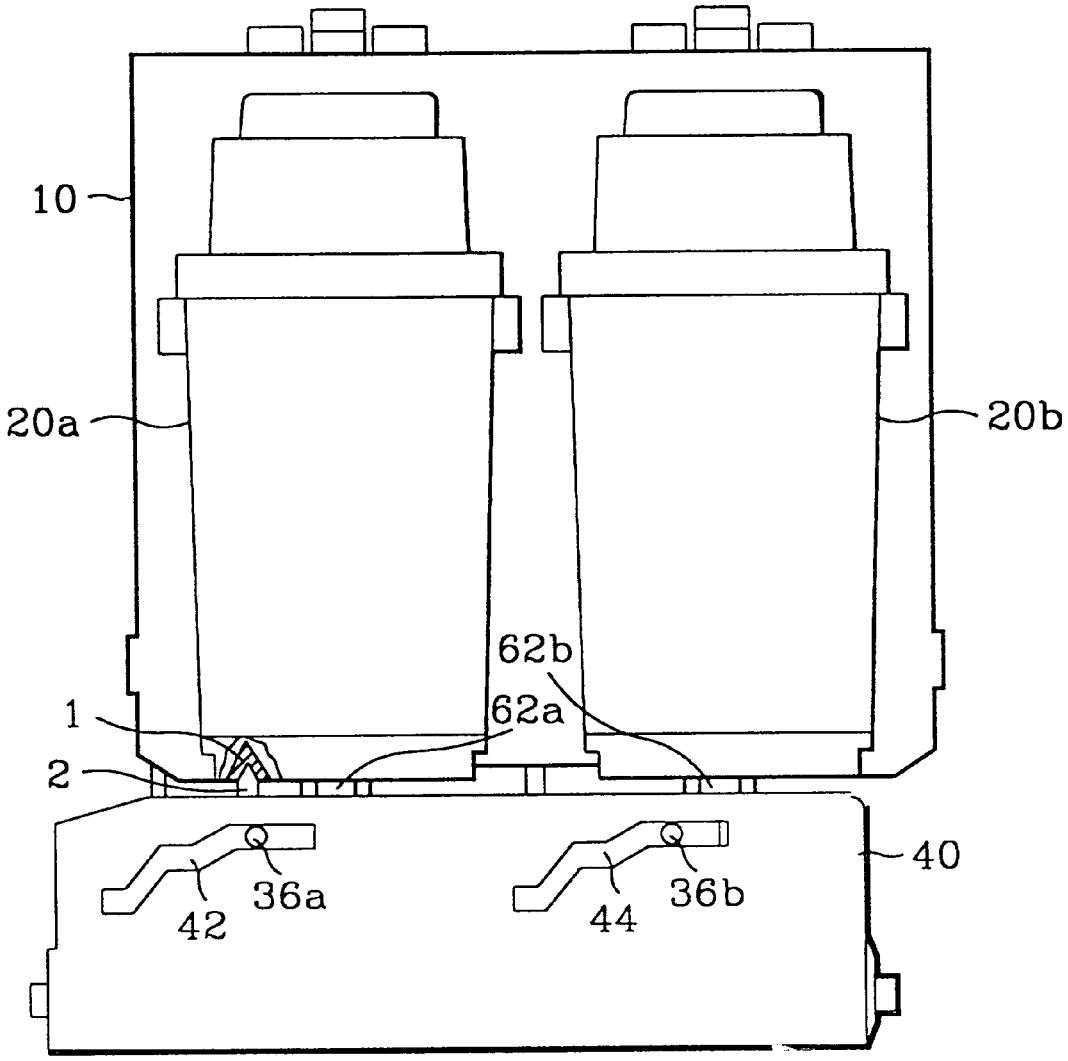

As FIGS. 3A and 3B illustrate the capping unit according to the present invention, when the carriage 10 connected with the timing belt is moved toward the home position, one side of a lever wiper 50 is latched by the carriage 10 and thus the carriage 10 is moved along with it, and the supporting shafts 36*a*, 36*b* of the sled 30 are moved along with sliding grooves 42, 44 to the right. In this case, as the sliding grooves 42, 44 were formed to be moved upwardly along with the guide gap, the sled 30 is moved upward. With continuous movement, the nozzle surface of the printer heads 22, 24 mounted at the carriage is inserted into the caps 62*a*, 62*b* so as to be closely adhered to, by means of the upward movement of the sled 30.

In this case, at the ink cartridge 20*a*'s lower part a guide groove 1 is formed, and at the sled 30 a boss 2 is formed in a shape complementary to that of the guide groove 1 such that the boss 2 is accurately inserted into the guide groove 1 when the printer head has got in touch with the caps 62*a*, 62*b*.

Namely, the boss 2 and the guide groove 1 play a role of fixing the ink cartridges 20*a*, 20*b* and the sled 30 when these are engaged with each other, thereby the accuracy of capping is improved.

Contrary to that, if a driving motor is operated to perform the printing on sheets of paper, the boss 2 is drifted away from the guide groove 1 and moved to the left. In this case, the supporting shafts 36*a*, 36*b* being formed at the sled 30 are moved along with the sliding grooves 42, 44, and after passing through the lever wiper 50, the supporting shafts 36*a*, 36*b* are moved to the far left side.

As can be seen from the foregoing description, the present invention provides accurate capping when the carriage having finished the printing process reaches the home position, with the guide groove formed on an earlier ink cartridge and with a corresponding boss formed on an earlier sled.

In the meantime, it is obviously understood by the person skilled in the art that the present invention is not limited to the particular embodiment disclosed herein as the best mode contemplated for carrying out the present invention, and that various alteration or modification thereof can be made within the present invention.

What is claimed is:

1. A capping unit for an ink-jet printer, comprising:

a carriage for said ink-jet printer supporting a print head, said carriage having a guide groove;

a frame bearing a plurality of grooves;

a sled slidably mounted in said plurality of grooves and slidable between a first position and a second position, said sled comprising:

a plurality of wipers that clean a nozzle of said print head;

a boss projecting toward said carriage and engageable with said guide groove in said carriage;

a plurality of cap holders supporting a plurality of caps attached to said plurality of cap holders; and a lever wiper having substantially an L-shape and having one end that engages said carriage to cause said sled to move with said carriage; and said lever wiper abutting said carriage while said sled is in said first position, where said plurality of caps of said sled are not contacting said nozzle, and causing said sled to slide in said plurality of grooves in said frame, thus causing said sled to move toward said second position, where said boss engages said guide groove in said carriage while said plurality of caps cover said nozzle.

2. A capping unit for an ink jet printer, comprising:

a carriage for said ink-jet printer supporting a print head, said carriage having a guide groove;

a frame bearing a plurality of grooves;

a sled slidably mounted in said plurality of grooves and slidable between a first position and a second position, said sled comprising:

a boss projecting toward said carriage and engageable with said guide groove in said print head;

a plurality of caps; and a lever wiper having substantially an L-shape and having one end that engages said carriage to cause said sled to move with said carriage; and said lever wiper abutting said carriage and causing said sled to move toward said print head to cover a nozzle of said print head with said plurality of caps while said boss engages said sled in said carriage.

3. The capping unit of claim 2, further comprised of said first position being where said sled is positioned in said plurality of grooves in said main frame so that said sled is as close to a base of said frame as possible and said second position being where said sled is positioned in said plurality of grooves so that said sled is as far from said base of said main frame as possible.

4. The capping unit of claim 3, said plurality of caps tightly covering said nozzle while said guide gap is in said second position.

5. The capping unit of claim 4, with said sled further comprising:

a plurality of fixing parts; and a plurality of cap holders attached in said fixing parts in said sled to support said plurality of caps.

6. The capping unit of claim 5, with said sled further comprising:

a plurality of ribs orientcd perpendicularly to said base of said frame; and a wiper attached over each of said plurality of ribs to affix each said wiper to said sled, said plurality of wipers cleaning said nozzle of said print head.

* * * * *